US008245366B2

(12) United States Patent
Morejon

(10) Patent No.: US 8,245,366 B2
(45) Date of Patent: Aug. 21, 2012

(54) CRIB BUMPER ATTACHMENT CLIP

(76) Inventor: Raphael J. Morejon, Miami, FL (US)

( * ) Notice: Subject to any disclaimer, the term of this patent is extended or adjusted under 35 U.S.C. 154(b) by 181 days.

(21) Appl. No.: 12/705,487

(22) Filed: Feb. 12, 2010

(65) Prior Publication Data

US 2010/0199467 A1 Aug. 12, 2010

Related U.S. Application Data

(60) Provisional application No. 61/152,012, filed on Feb. 12, 2009.

(51) Int. Cl.
*A44B 18/00* (2006.01)
*A44B 99/00* (2010.01)

(52) U.S. Cl. ..... 24/457; 24/3.1; 24/3.11; 24/3.12; 24/72.5; 24/442; 24/478; 24/481; 24/484; 24/485; 24/522; 24/529; 24/532; 24/536; 5/93.1

(58) Field of Classification Search ..... 24/3.1, 24/3.11, 3.13, 3.12, 72.5, 302, 442, 478, 24/481, 484, 485, 522, 529, 532, 536, 501; 5/93.1
See application file for complete search history.

(56) References Cited

U.S. PATENT DOCUMENTS 3,296,668 A 1/1967 Petersburg
4,716,634 A * 1/1988 Fan ..... 24/545
5,014,892 A * 5/1991 Copeland ..... 224/271
5,161,276 A * 11/1992 Hutton et al. ..... 5/692
5,191,664 A * 3/1993 Wyatt ..... 5/498
5,361,948 A * 11/1994 Batts ..... 223/96
5,400,478 A * 3/1995 Levinsohn et al. ..... 24/72.5
5,410,765 A * 5/1995 Youngblood ..... 5/93.1
5,421,046 A * 6/1995 Vande Streek ..... 5/624
5,778,465 A * 7/1998 Myers ..... 5/99.1
D400,718 S * 11/1998 Bortolus ..... D6/328
5,890,634 A * 4/1999 Zuckerman et al. ..... 223/96
6,199,728 B1 * 3/2001 Cohen ..... 223/96
6,418,595 B1 * 7/2002 Shih ..... 24/536
6,550,082 B2 * 4/2003 Tharalson et al. ..... 5/95
6,564,403 B1 * 5/2003 Titus ..... 5/425
6,708,356 B1 3/2004 LaValle
6,957,455 B1 * 10/2005 Misson ..... 5/425
7,213,282 B1 * 5/2007 Wojtowicz ..... 5/93.1
2001/0000362 A1 * 4/2001 Wagner et al. ..... 5/424
2002/0062522 A1 5/2002 Deckert
2003/0159257 A1 * 8/2003 Lewis ..... 24/536
2006/0225205 A1 * 10/2006 Troutman ..... 5/93.1

* cited by examiner

*Primary Examiner* — Robert J Sandy
*Assistant Examiner* — David Upchurch
(74) *Attorney, Agent, or Firm* — Albert Bordas, P.A.

(57) ABSTRACT

A clip assembly is provided for securing a crib bumper to a crib. The clip assembly may include a clip adapted to be secured to the crib bumper. The clip may include a body member having a first arm and a second arm coupled to the first arm. The clip may also include a clasping member carried by the body member and adapted to clasp the first arm and the second arm. The clip assembly may also include a belt adapted to secure the clip to a portion of the crib. The belt may include a strap member having a fastener, adapted to secure the strap member to the crib portion. The belt may also include a protruding member carried by the strap member and adapted to be received by the linking member.

2 Claims, 8 Drawing Sheets

CRIB BUMPER ATTACHMENT CLIP

CROSS REFERENCE TO RELATED APPLICATION

This application claims the benefit of U.S. Provisional Application No. 61/152,012 filed on Feb. 12, 2009, the disclosure of which is incorporated by reference.

FIELD OF THE DISCLOSURE

The present disclosure generally relates to fastening mechanisms, and, more particularly, to a clip assembly capable of securing a crib bumper to a crib.

BACKGROUND OF THE DISCLOSURE

Crib bumpers are a very common infant care product. Parents or caregivers often use crib bumpers for the comfort and safety of their infants. Conventional crib bumpers may be manufactured with numbers of tie strings, which extend from various portions of the crib bumpers. The tie strings aid in securing the crib bumper to a crib. When the infant urinates or defecates in the crib, a crib sheet, placed in the crib, needs to be changed for hygiene reasons. The changing of the crib sheet requires the removal of the crib bumper from the crib. The task of tying and untying numbers of tie stings may become very lengthy and tedious. Moreover, use of both hands for tying and untying the tie stings makes the removal and securing of the crib bumper more cumbersome.

SUMMARY OF THE DISCLOSURE

In one aspect of the embodiments of the present invention, a clip assembly is provided for securing a crib bumper to a crib. The clip assembly may include a clip adapted to be secured to the crib bumper. The clip may include a body member having a first arm and a second arm formed integral with or otherwise coupled to the first arm. The clip may also include a clasping member carried by the body member. The clasping member may be adapted to clasp the first arm and the second arm for securing the body member to the crib bumper. The clip assembly may also include a belt adapted to secure the clip to a portion of the crib. The belt may include a strap member having a fastener. The fastener may be adapted to secure the strap member to the crib portion. The belt may also include a protruding member carried by the strap member. The protruding member may be adapted to be received by a cavity formed in the clip for supporting the clip onto the crib portion, thereby securing the crib bumper onto the portion of the crib.

BRIEF DESCRIPTION OF THE DRAWINGS

The advantages and features of the present disclosure will become better understood with reference to the following detailed description and claims taken in conjunction with the accompanying drawing, in which:

Like reference numerals refer to like parts throughout the description of several views of the drawings.

DETAILED DESCRIPTION OF THE DISCLOSURE

The exemplary embodiments described herein detail for illustrative purposes are subject to many variations in structure and design. It should be emphasized, however, that the present disclosure is not limited to a particular clip assembly as shown and described. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The terms, "first," "second," and the like, herein do not denote any order, elevation or importance, but rather are used to distinguish one element with another. Further, the terms, "a" and "an" herein do not denote a limitation of quantity, but rather denote the presence of at least one of the referenced item.

The present disclosure provides embodiments of a clip assembly capable of securing a crib bumper to a crib. The clip assembly may assist parents or caregivers to conveniently remove and secured the crib bumpers onto railings of the crib.

Figure 1:
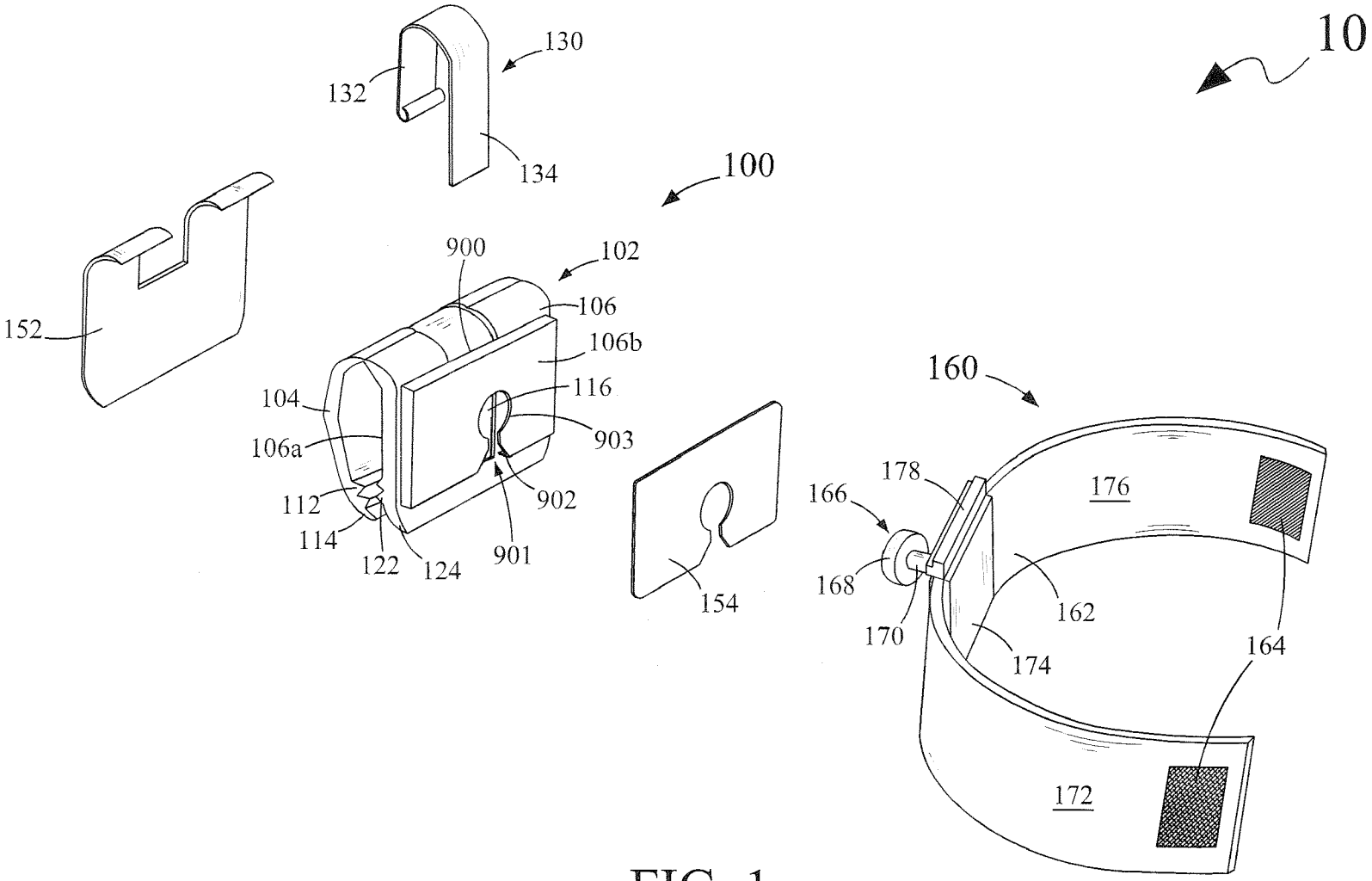
FIG. 1 is an exploded perspective view of one embodiment of a clip assembly.

Referring to FIG. 1, a clip assembly 10 may include a clip 100. The clip 100 may include a body member 102. The body member 102 may have a U-shaped structure. Specifically, the body member 102 may include a first arm 104 and a second arm 106, which may be integral with the first arm 104 for configuring the U-shaped body member 102.

Figure 2:
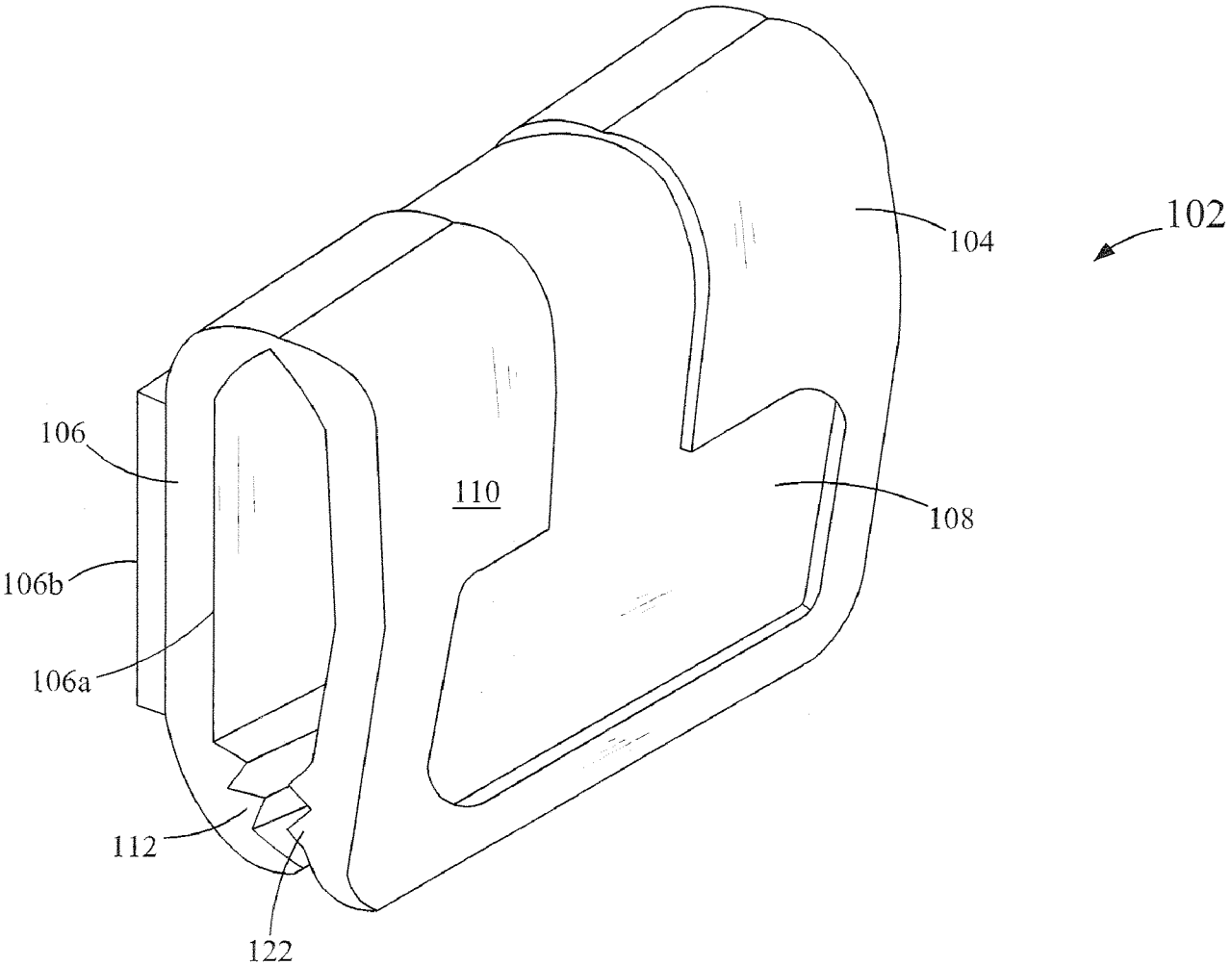
FIG. 2 is a perspective view of a body member of a clip of the clip assembly of FIG. 1.

The first arm 104 may have a curved rectangular plate-like structure. However, the first arm 104 may alternatively have a circular, an oval, or a polygonal curved plate-like structure. Further, the first arm 104 may include a channel 108, which may extend along an outer surface 110 of the first arm 104, as shown in FIG. 2. The first arm 104 may also include griping teeth 112 carried by an end portion 114 of the first arm 104.

The second arm 106 may have a relatively flat rectangular plate like structure. However, the second arm 106 may alternatively have a circular, an oval, or a polygonal relatively flat plate-like structure. Second arm 106 includes first and second spaced apart walls 106*a* and 106*b*, respectively. Wall 106*a* resides opposite first arm 104, while wall 106*b* resides opposite wall 106*a* on a side of wall 106*a* that is opposite the side on which first arm 104 is positioned. Walls 106*a* and 106*b* define a cavity 116 therebetween for receiving therein a straight portion 134 of a clasping member 130 (described in greater detail below). In addition, an opening 901 is formed in wall 106*b* for receiving a tab 168 (described below) therein for mounting the clip assembly to a crib. Opening 901 may include chamfered or tapered lead-in portion 902 and a terminal portion 903 sized to prevent passage of the tab 168 therethrough after the tab has been inserted into the opening via the lead-in portion. Walls 106*a* and 106*b* may be formed integrally with each other, or the walls may be formed separately and wall 106*b* attached to wall 106*a* using an adhesive or any other suitable means. A slot 900 may be formed in second arm 106 for receiving straight portion 134 into cavity 116. Further, the second arm 106 may also include griping teeth 122 carried by an end portion 124 of the second arm 106.

The clip 100 may also include a resiliently deflectable clasping member 130 adapted to be mounted on the body member 102. The clasping member 130 may include a bent portion 132 and straight portion 134, which may be integral with or otherwise coupled to the bent portion 132. The clasping member 130 may be adapted to clasp the first aim 104 and the second arm 106 together. The straight portion 134 may be inserted in the slot 900 of the second arm 106 for allowing the bent portion 132 to be slidably received on the channel 108 of the first arm 104, thereby clasping and holding the first arm 104 and the second arm 106 together. Straight portion 134 extends into cavity 116 between walls 106*a* and 106*b* and may include a detent formed thereon to aid in preventing complete removal of straight portion 134 from slot 900. In this manner, clasping member 130 is retained in body member 102. The detent may have any suitable form. For example, a part of straight portion 134 may be notched or otherwise deformed after insertion into slot 900 so as to prevent the deformed part of the straight portion from passing back through the slot. The detent engages another portion of the clip 100 to prevent withdrawal of the clip from the slot 900.

Figure 2A:
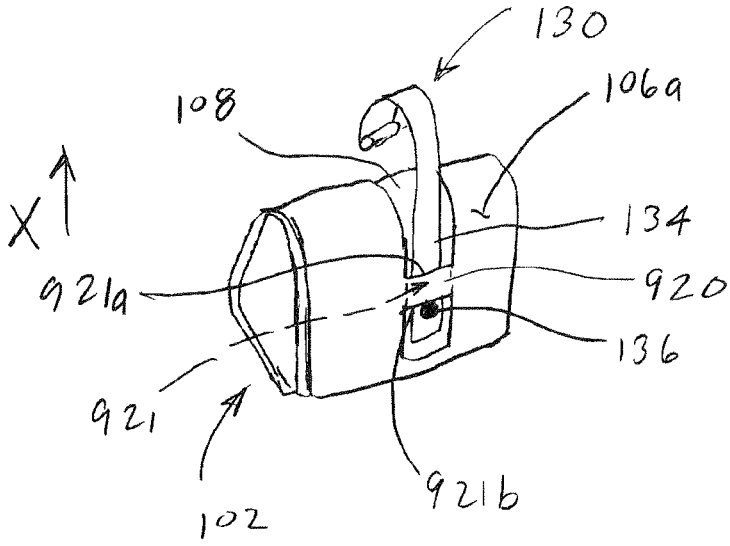
FIG. 2*a* shows a portion of a clip in accordance with an embodiment of the present invention.
Figure 2B:
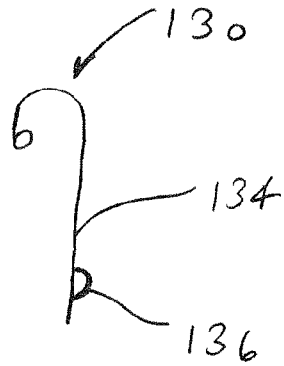
FIG. 2*b* shows a side view of a clasping member in accordance with an embodiment of the present invention.

FIG. 2*a* shows a particular embodiment of clip body 102 with second wall 106*b* removed to illustrate the interior of cavity 116. Referring to FIG. 2*a*, at least a portion of first arm channel 108 extends along second aim 106, for guiding the straight portion 134 of clasping member 130 within cavity 116. A support bar 920 may be molded into or otherwise positioned on second arm within cavity 116 for engaging a detent feature 136 positioned on the clasping member 130. The support bar may be in the form of a web extending between or spanning opposite edges of the portion of channel 108 extending along second arm 106, thereby covering a portion of channel 108 and defining a covered slot or passage 921 residing along channel 108 and which is aligned with slot 900. Passage 921 has a first opening 921*a* at a first end of the passage, and a second opening 921*b* at a second end of the passage.

Straight portion 134 is inserted from a first side of the passage into opening 921*a* and extends through the passage, exiting the passage at opening 921*b*, whereupon a part of the straight portion resides on a second side of the passage opposite the first side. The clasping member detent 136 is in the form of a bump or other feature formed along the part of straight portion 134 residing on the second side of the passage. The detent feature is sized so as to abut support bar 920 when the straight portion moves in direction "X", thereby preventing removal of the straight portion from passage 921. This retains clasping member 130 on body member 102. Other forms of detent, whether formed into the straight portion or added onto the straight portion after insertion into slot 900, are also contemplated.

Figure 3:
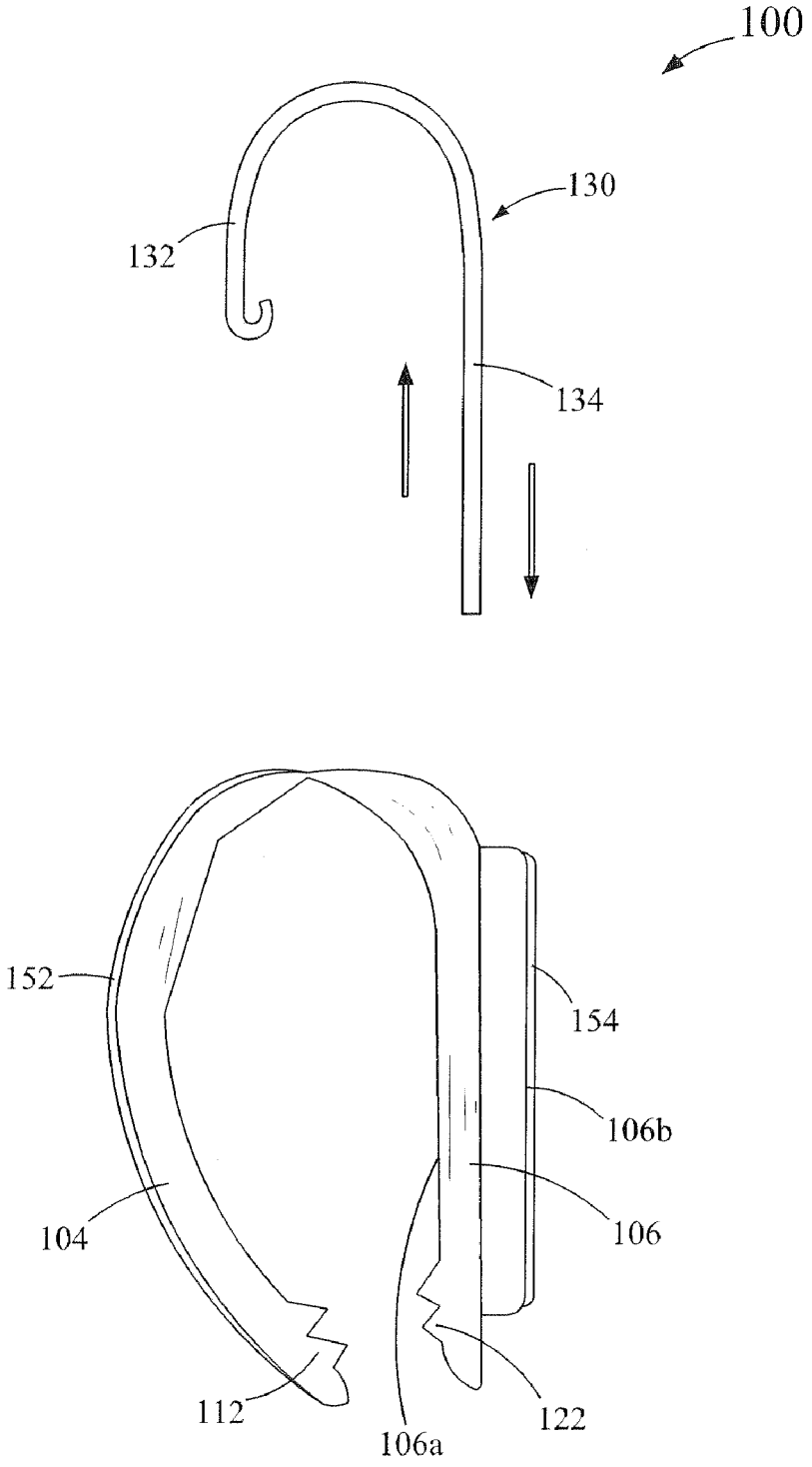
FIG. 3 is a side view of the clip of the clip assembly of FIG. 1 in an un-clasped state.

As shown in FIG. 3, the straight portion 134 of the clasping member 130 may be inserted in the slot 900 (shown in FIG. 1) of the second arm 106. The clasping member 130 may be moved in a downward direction, shown with a downward arrow, for allowing the clasping member 130 to be received on the body member 102. Further, the bent portion 132 of clasping member 130 may be slidably received on the channel 108 (shown in FIG. 2) of the first arm 104, for allowing the clasping member 130 to clasp the first arm 104 and the second arm 106 together, as shown FIG. 4.

In the present embodiment, a distance between the bent portion 132 and the straight portion 134 of the clasping member 130 may be less than a distance between outer surfaces of the first arm 104 and the second arm 106 of the body member 102. Therefore, when the straight portion 134 is inserted in the slot 900, the bent portion 132 may be slidably received by the channel 108, producing a resilient deflection of the clasping member. This resilient deflection creates a reaction force which tends to clasp the first arm 104 and the second arm 106 together.

Figure 4:
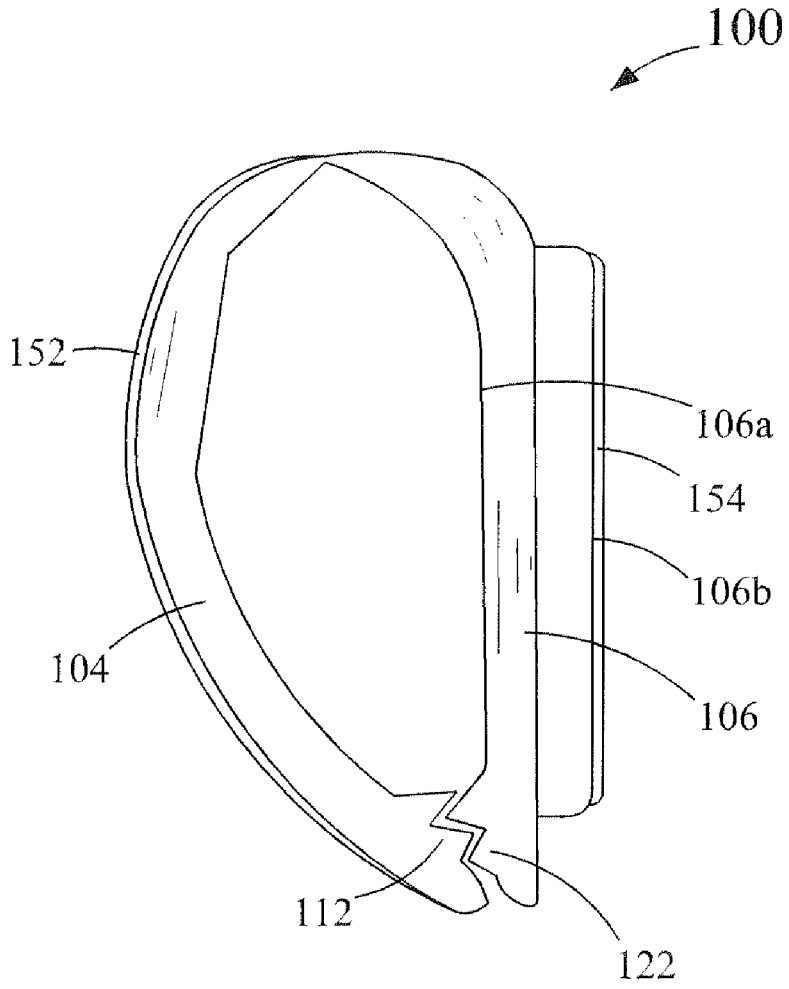
FIG. 4 is a side view of the clip of the clip assembly of FIG. 1 in a clasped state.

Further, when the straight portion 134 is received in the cavity 116, the straight portion 134 may be supported by wall 106*a*. Furthermore, when the first arm 104 and the second arm 106 are clasped together the griping teeth 112 and the griping teeth 122 may contact each other, as shown in FIG. 4. Moreover, upon removing the clasping member 130 from its engaged position securing the first and second arms together, the body member 102, the first arm 104 and the second arm 106 may become unclasped, as shown in FIG. 3. For example, the clasping member 130 may be moved in an upward direction, shown with an upward arrow, for removing the clasping member 130 from the body member 102, thereby unclasping the first arm 104 and the second arm 106.

The clip 100 may further include at least one cushion pad. In the present embodiment, the clip 100 may include a pair of cushion pads 152, 154 which may be disposed on the body member 102. Specifically, the pair of cushion pads 152, 154 may be disposed on the outer surfaces 110 and 118 of the first arm 104 and the second arm 106, respectively, as shown in FIGS. 3 and 4. The pair of cushion pads 152, 154 may be attached to the outer surfaces 110 and 118, respectively, with the help an adhesive. The pair of cushion pads 152, 154 may provide a soft outer cover on the clip 100.

The clip assembly 10 of the present disclosure may further include a belt 160 having a strap member 162. The strap member 162 may be a flexible structure, such as an elastic band. Further, the strap member 162 may include a fastener 164 carried by end portions of the strap member 162. In the present embodiment, the fastener 164 may be a hook and loop fastener carried by the end portions of the strap member 162. Alternatively, the fastener 164 may be a snap buttons, and the like.

The belt 160 may also include a protruding member 166 carried by the strap member 162. The protruding member 166 may include a round tab 168 and an elongated tab 170 extending from the round tab 168. As stated previously, tab 168 is sized so as to prevent removal of the tab through terminal portion 903 of opening 901 after the tab has been inserted into opening 901 via lead-in portion 902. Further, the elongated tab 170 may be carried by an outer surface 172 of the strap member 162. Specifically, the elongated tab 170 of the protruding member 166 may be rigidly attached to a central portion of the outer surface 172 of the strap member 162.

The belt 160 may further include a plate member 174 carried by the strap member 162. Specifically, the plate member 174 may be carried by an inner surface 176 of the strap member 162, and positioned opposite to the protruding member 166. The plate member 174 may be a rectangular structure having a ridge portion 178. The ridge portion 178 may extend above the strap member 162 when the plate member 174 is disposed on the strap member 162. The plate member 174 may be rigidly attached to the inner surface 176 of the strap member 162. For example, the plate member 174 and the protruding member 166 may be rigidly coupled to each other, with the strap member 162 therebetween, with the help of a screw (not shown).

Figure 5:
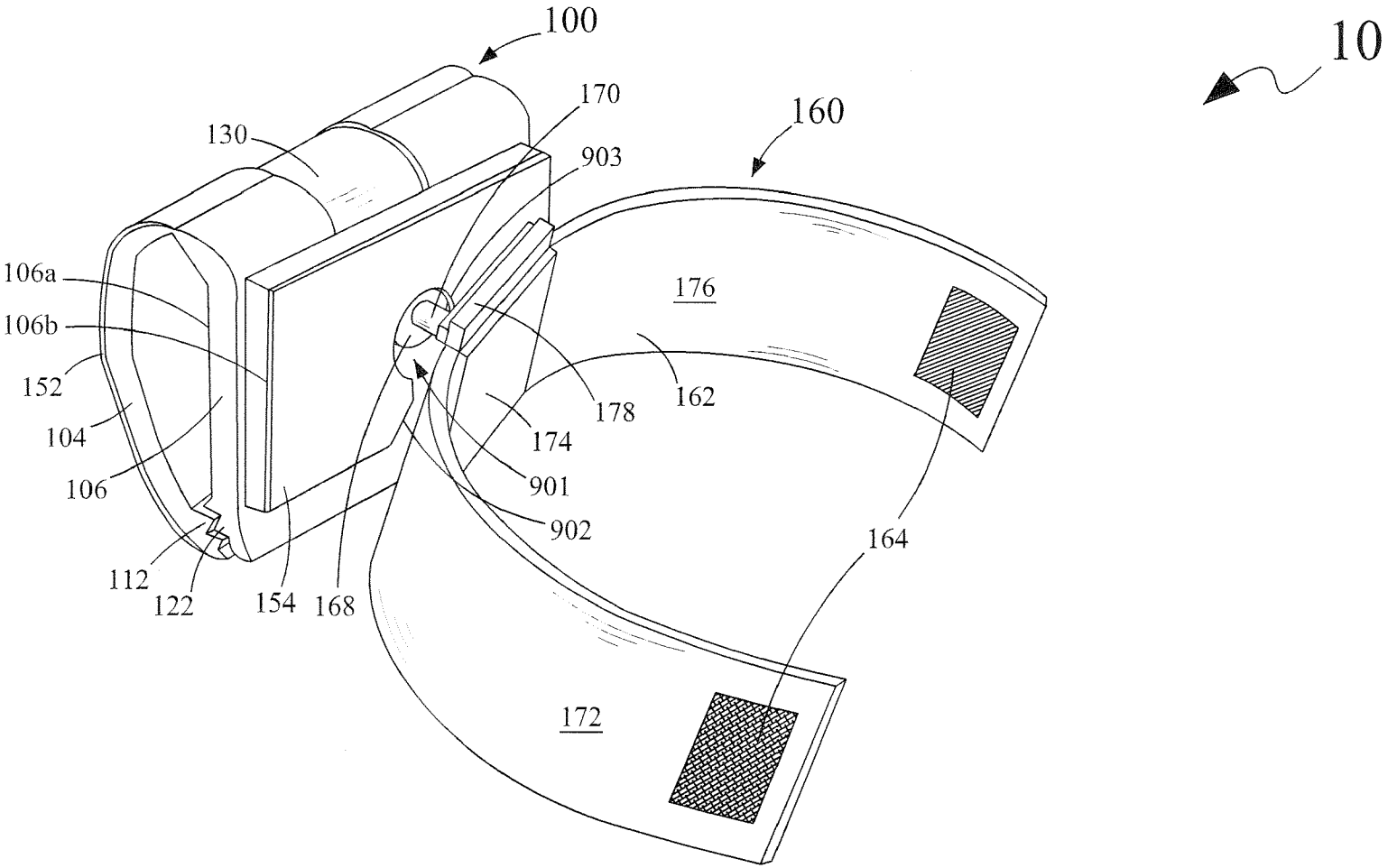
FIG. 5 is a perspective view of the clip assembly of FIG. 1 in an assembled state.
Figure 6:
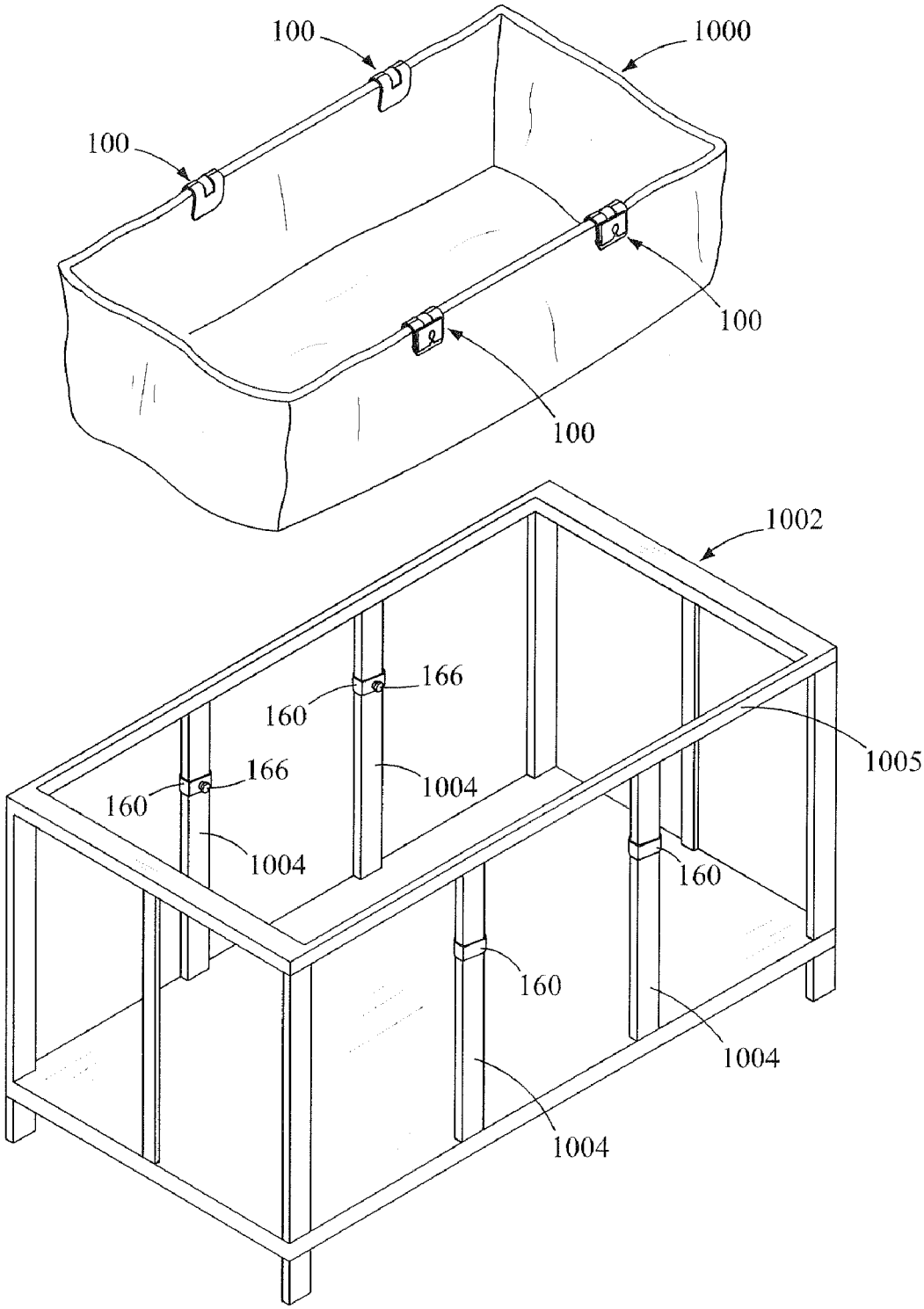
FIGS. 6 and 7 show an environment in which the clip assembly of FIG. 1 may be utilized for securing a crib bumper to a crib.
Figure 7:
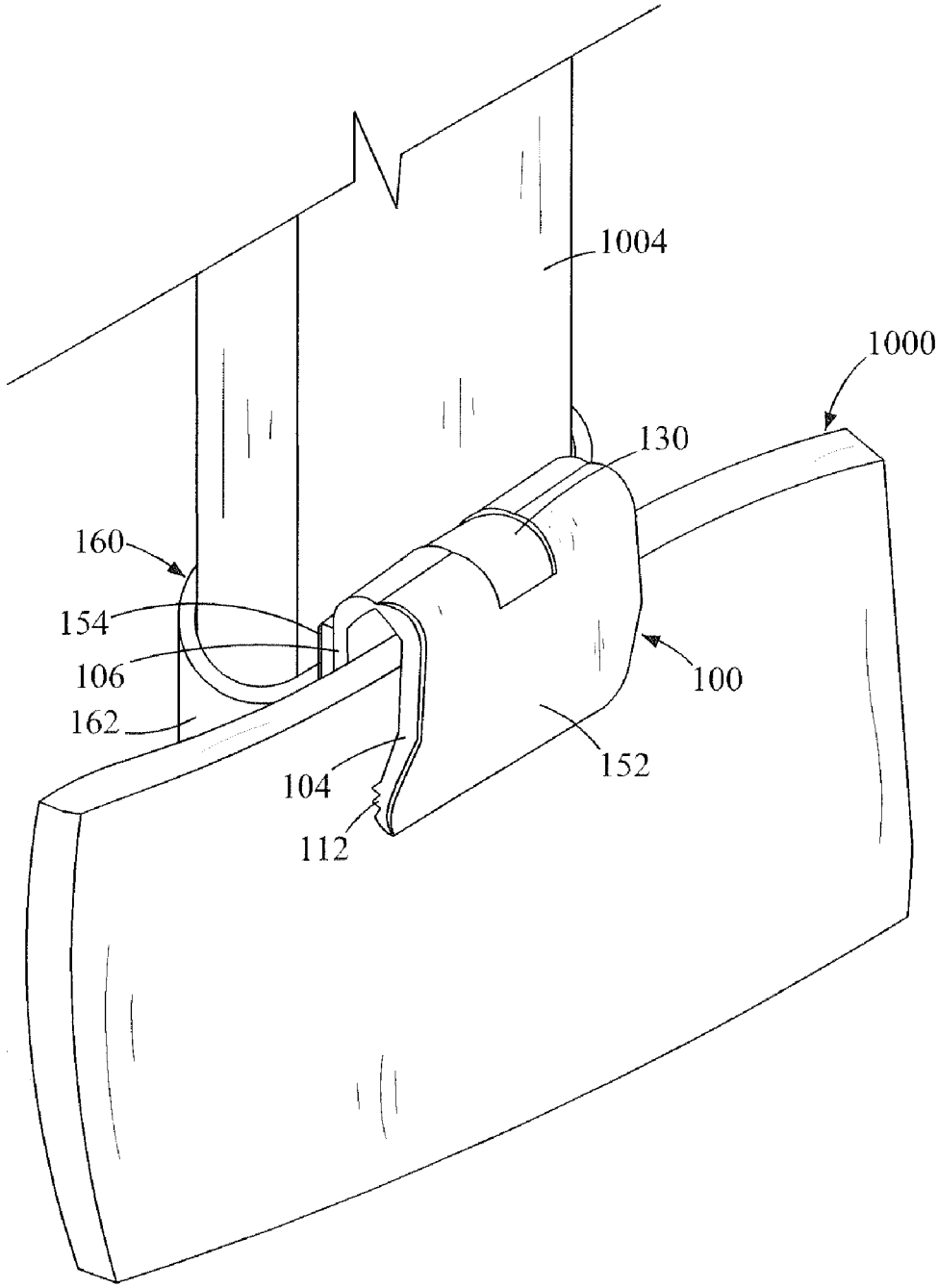

In use, the clip 100 and the belt 160 of the clip assembly 10 may be assembled in a manner as shown in FIG. 5, with round tab 168 inserted into opening 901 so as to reside between first and second walls 106*a* and 106*b* and positioned such that the clip 100 hangs on elongated tab 170. Specifically, as shown in FIGS. 6 and 7, in use, the clip assembly 10 of the present disclosure may enable in securing a crib bumper 1000 to a crib 1002. FIG. 7 shows only the portion of crib bumper 1000 secured within clip 100. It should be understood that for securing the crib bumper 1000 to the crib 1002 a plurality of clip assemblies, such as the clip assembly 10, may be utilized.

Further, for securing the crib bumper 1000 to the crib 1002, the clip 100 of the clip assembly 10 may be clasped onto the crib bumper 1000. Specifically, the crib bumper 1000 may be positioned between the first arm 104 and the second arm 106 of the body member 102. Thereafter, the clasping member 130 may be received by the body member 102 (as explained in conjunction with FIGS. 3 and 4) for allowing the first arm 104 and the second arm 106 to clasp together and secure the crib bumper 1000 therebetween, as shown in FIG. 7. In the clasped state, the griping teeth 112 and the griping teeth 122 of the first arm 104 and the second arm 106, respectively, may enable the clip 100 to be rigidly secured onto the crib bumper 1000.

The belt 160 of the clip assembly 10 may be secured onto a railing 1004 of the crib 1002, as shown in FIG. 6. Specifically, the strap member 162 of the belt 160 may wrap around the railing 1004 such that the fastener 164, carried by the end portions of the strap member 162, may allow the end portions of the strap member 162 to engage each other, as shown in FIG. 7. As mentioned herein, the strap member 162 may be made of elastic material thereby enabling the strap member 162 to be adjustably secured onto the railing 1004 and permitting adjustable securement of the strap member 162 to railings of different thickness. Further, the strap member 162 may be secured onto the railing 1004 in a manner such that the protruding member 166, carried by the strap member 162, may be positioned within the crib 1002, as shown in FIG. 6.

Once the belt 160 is secured onto the railing 1004, the clip 100 which is secured to the crib bumper 1000 may be engaged to the belt 160. Specifically, the protruding member 166 of belt 160 may be received in opening of the clip 100 as shown in FIG. 5. As stated previously, tab 168 and terminal portion 903 of opening 901 are dimensioned with respect to each other so that the tab cannot be withdrawn from the cavity 116 through terminal portion 903 when the tab has been inserted in to cavity 116 via opening 901 and resides within terminal portion 903. Similarly, the plurality of clips, such as the clip 100, may be secured onto the crib bumper 1000 in the manner just described, and may further be engaged with an associated plurality of belts, such as the belt 160 secured on the railings of the crib 1000, for securing the crib bumper 1000 onto railings of the crib 1002.

Further, for the removing the crib bumper 1000 from the crib 1002 an individual may use a single hand. More specifically, the individual may place his/her thumb on the plate member 174, particularly on the ridge portion 178 of the plate member 174, such that the thumb touches a top of the clip 10. Thereafter, an index finger of the individual may be placed on the first arm 104. Specifically, the index finger may be placed on the cushion pad 152 of the first arm in 104, and thereafter the individual may move the first arm 104 upward with the help of the index finger, thereby disengaging the clip 100 from the belt 160. Similarly, the plurality of clips, such as the clip 100, secured onto the crib bumper 1000 may be disengaged from the plurality of belts, such as the belt 160, secured on the railings, thereby removing the crib bumper 1000 from the railings of the crib 1002.

Based on the foregoing description of the present disclosure, a clip assembly as described herein, may enable parents or caregivers to conveniently secure a crib bumper to a crib, thereby saving time and energy. Elements of a clip in accordance with an embodiment of the present invention, may be made of a machine or hand washable material, such as temperature-resistant plastic or any other suitable material. Therefore, the clip may be permanently secured on the crib bumper for allowing the washing of the crib bumper along with the clip, which may preclude a need of removing and reinstalling the clip on the crib bumper.

In an alternative embodiment, a belt similar in structure and function to belt 160 may be configured for attachment to a portion of the crib other than one of vertical railings 1004. For example, several belts may be attachable to one of horizontal railings 1005 (see FIG. 6) and may be spaced apart along the horizontal railings to enable mounting of the crib bumper clips thereon.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. A clip assembly for securing a crib bumper to a crib, said clip assembly comprising:

A) a clip adapted to be secured to said crib bumper, said clip comprising a body member having a first arm, and a second arm coupled to said first arm, said first arm and said second combine to form a U-shaped structure, said second arm includes first and second spaced apart walls, said clip further comprising first and second cushion pads disposed on said body member, said first cushion pad comprises a second tapered entry portion and a second terminal portion in communication with said second tapered entry portion;

B) a clasping member carried by said body member, said clasping member adapted to clasp said first arm and said second arm for securing said body member to said crib bumper, said clasping member comprises a bent portion, and a straight portion coupled to said bent portion, said straight portion is adapted to be received by a cavity formed in one of said first and second arms for allowing said bent portion to be slidably received on a cavity formed in said other of said first and second arms, thereby allowing said clasping member to clasp said first arm and said second arm;

C) a belt adapted to secure said clip to a portion of said crib, said belt comprising a strap member having a fastener adapted to secure said strap member to said portion of said crib, and a protruding member coupled to said strap member, at least a portion of said protruding member is adapted to be received in a cavity formed in said clip for supporting said clip on said portion of said crib, thereby securing said crib bumper to said portion of said crib, said belt further comprises a plate member carried by said strap member opposite to said protruding member, said plate member having a ridge portion that extends above said strap member when said plate member is disposed on said strap member; and D) an opening is formed in one of said first arm and said second arm, said opening enabling communication between said cavity and an exterior of said cavity, and wherein a portion of said opening is sized with respect to said at least a portion of said protruding member received in said cavity so as to prevent withdrawal of said at least a portion of said protruding member from said cavity through said portion of said opening, said opening including a first tapered entry portion and a first terminal portion in communication with said first tapered entry portion.

2. The clip assembly for securing a crib bumper to a crib set forth in claim 1, further characterized in that said fastener comprises a hook and loop fastener.

* * * * *